US005528777A

United States Patent [19]

Arft

[11] Patent Number: 5,528,777

[45] Date of Patent: Jun. 25, 1996

[54] SOFA SLEEPER DECK WITH TRANSVERSE SLATS

[75] Inventor: Dennis E. Arft, Joplin, Mo.

[73] Assignee: L&P Property Management Company, Chicago, Ill.

[21] Appl. No.: 369,117

[22] Filed: Jan. 5, 1995

[51] Int. Cl.[6] ..... A47C 17/207

[52] U.S. Cl. ..... 5/13; 5/28; 5/29; 5/51.1; 5/238

[58] Field of Search ..... 5/12.1, 13, 28, 5/29, 51.1, 236.1, 238

[56] References Cited

U.S. PATENT DOCUMENTS

| | | | |
|---|---|---|---|
| 88,146 | 3/1869 | Dourson . | |
| 123,620 | 2/1872 | Dourson . | |
| 1,527,416 | 2/1925 | Konrad . | |
| 2,853,717 | 9/1958 | Firsel | 5/12.1 X |
| 2,878,490 | 3/1959 | Schneider . | |
| 3,813,713 | 6/1974 | Kipfer | 5/238 |
| 3,854,153 | 12/1974 | Fadler et al. . | |
| 4,381,570 | 5/1983 | Schneider | 5/29 X |
| 4,494,258 | 1/1985 | Blevins et al. | 5/13 X |
| 4,504,987 | 3/1985 | Spitz | 5/13 |
| 4,584,727 | 4/1986 | Reiss et al. . | |
| 5,257,424 | 11/1993 | Rogers | 5/13 |

*Primary Examiner*—Michael F. Trettel
*Attorney, Agent, or Firm*—Wood, Herron & Evans

[57] ABSTRACT

An improved sofa sleeper deck includes a number of pivotal transverse slats secured to a foldable frame. Each slat is pivotally coupled to a linkage so that the slats can pivot between vertical and horizontal orientations in the extended bed configuration or the collapsed sofa configuration, respectively. In the bed configuration, the vertical slats provide a stable rigid support deck for the mattress to avoid the problems of hammocking and the like associated with previous sofa sleeper decks. The slats in a horizontal configuration provide a comfortable cushion seating surface for the sofa in the collapsedapsed configuration and an enlarge cavity to accommodate a thicker or bigger mattress collapsed into the sofa.

21 Claims, 4 Drawing Sheets

SOFA SLEEPER DECK WITH TRANSVERSE SLATS

BACKGROUND OF THE INVENTION

This invention relates to a combination sofa sleeper bed, and more particularly, to an improved sofa sleeper deck structure.

Sofa sleepers are well known in the prior art. Basically, a sofa sleeper includes a foldable bed frame which supports a mattress when the bed frame is extended to a generally flat, horizontal bed configuration. A sofa sleeper is adapted for use as a sofa when the bed frame is folded up into a collapsed storage configuration within the framework of the sofa to permit use of the structure as a seating surface.

A problem with sofa sleepers is that they offer little resistance or support when a person sits, reclines or rests on the unfolded sofa bed. This yield and effect is known in the bedding industry as "hammocking" and results in persons atop the mattress supported on the unfolded sofa bed feeling the underlying support members. As a result, sofa sleepers have been considered a compromise and a less satisfactory sleeping surface than a standard bed.

One prior solution to the problem of hammocking in sofa sleeper structures is disclosed in U.S. Pat. No. 2,878,490. The deck of the sofa sleeper in this patent includes a wire mesh or wire grid attached to the foldable bed frame. The wire grid either extends the full length of the foldable bed frame or a major portion thereof, the remainder being made from cloth. This wire grid or wire and cloth grid is connected with the sides of the foldable bed frame by a plurality of tension springs in order to maintain the grid in a taut and partially resilient posture when the frame is unfolded for use as a bed. However, the wire grid, or wire and cloth grid, even with the tension springs does not maintain the sofa sleeper deck in a sufficiently taut and resilient manner to avoid sagging of the unfolded sofa sleeper.

Another prior art solution to the problem of sag in a sofa sleeper deck is described in U.S. Pat. No. 4,584,727 which discloses a sofa sleeper deck wherein the deck is divided up into head, body, intermediate, and foot sections. The foot section is comprised of a plurality of sinuous wires. The remaining sections are constructed of plywood as either solid panels, individual slats, or pairs of slats. Although the plywood deck may solve the problem of hammocking to provide a resilient sleeping surface, a problem associated with a sofa sleeper deck of such construction is that the plywood panels are excessively rigid and therefore provide an uncomfortable seating surface when the deck is collapsed into the sofa. Furthermore, a sofa sleeper constructed with a plywood deck is extremely heavy, costly, and very difficult to move and transform to and between the sofa configuration and the sleeper configuration.

Sofa sleeper decks which merely include longitudinal slats, for example, of the type disclosed in U.S. Pat. No. 1,527,416, do provide a more lightweight deck construction. However, they do not provide a very rigid support structure for the mattress in the sleeper configuration. As a result, hammocking still occurs in sofa sleeper decks of this type.

SUMMARY OF THE INVENTION

It has therefore been an objective of this invention to provide an improved sofa sleeper deck which provides a resilient sleeping surface for supporting a mattress thereon and a soft, comfortable seating surface when collapsed into the sofa.

It has been a further objective of this invention to provide such a sofa sleeper deck which has serially interconnected and individually articulated panels or sections which can be economically manufactured and easily moved and transformed to and between the sofa and sleeper configurations.

A still further objective of this invention has been to provide a sofa sleeper mattress deck that eliminates the problems of hammocking.

A still further objective of the invention is to provide a sofa sleeper mattress deck that can accommodate a thicker sofa bed mattress while providing for neat and compact storage or folding of the mattress in the collapsed sofa configuration.

In accordance with these objectives, the improved sofa sleeper of this invention comprises a foldable bed frame which unfolds and extends to provide a generally flat, horizontal bed or collapses and retracts into the sofa to provide a seating section. When extended into the bed configuration, the sofa sleeper deck includes head, body, intermediate and foot sections which are serially interconnected. The body and foot sections of the sofa sleeper deck comprise a series of spaced, parallel, transverse slats which extend between the opposed sides of the foldable frame. The slats extending across the width of the sofa sleeper deck replace the conventional wire mesh or fabric decks well known in the prior art.

According to this invention, the slats are pivotally coupled to the foldable bed frame so that the slats can pivot through approximately 90° in one embodiment so that the slats are located in parallel, vertical planes when the deck is unfolded into the bed configuration. Each slat is generally oval in cross-sectional configuration and has a major dimension greater than a minor dimension thereof. Therefore, when the slats are positioned in parallel vertical planes with the sofa sleeper in the bed configuration, they provide a very rigid mattress supporting surface for the sofa sleeper bed. When the sofa sleeper is collapsed into the sofa configuration, the slats pivot through approximately 90° in one embodiment so that they are generally flat or horizontal and parallel to the deck sections which are collapsed into the sofa sleeper. Thus, the slats are compact and take up very little storage space within the limited space confines of the sofa sleeper frame and are relatively flexible in the seating position to give a relatively soft seat. Yet they are very rigid when the bed is unfolded and in a sleeping position. A linkage system is provided according to this invention to connect the slats to the sofa sleeper frame and thereby facilitate the automatic pivotal movement of the slats between generally horizontal and vertical orientations.

An additional advantageous feature is provided with the sofa sleeper deck according to this invention so that the rigid support surface provided by the slats in the bed configuration is adjustable according to one's personal preference. An actuator or lever is provided for the manual adjustment of the angular orientation of the slats when the deck is in the unfolded bed configuration. As a result, the rigidity of the mattress supporting surface is adjustable.

BRIEF DESCRIPTION OF THE DRAWINGS

The objectives and features of this invention will become more readily apparent from the following detailed description taken in conjunction with the accompanying drawings in which.

DETAILED DESCRIPTION OF THE INVENTION

Figure 1:
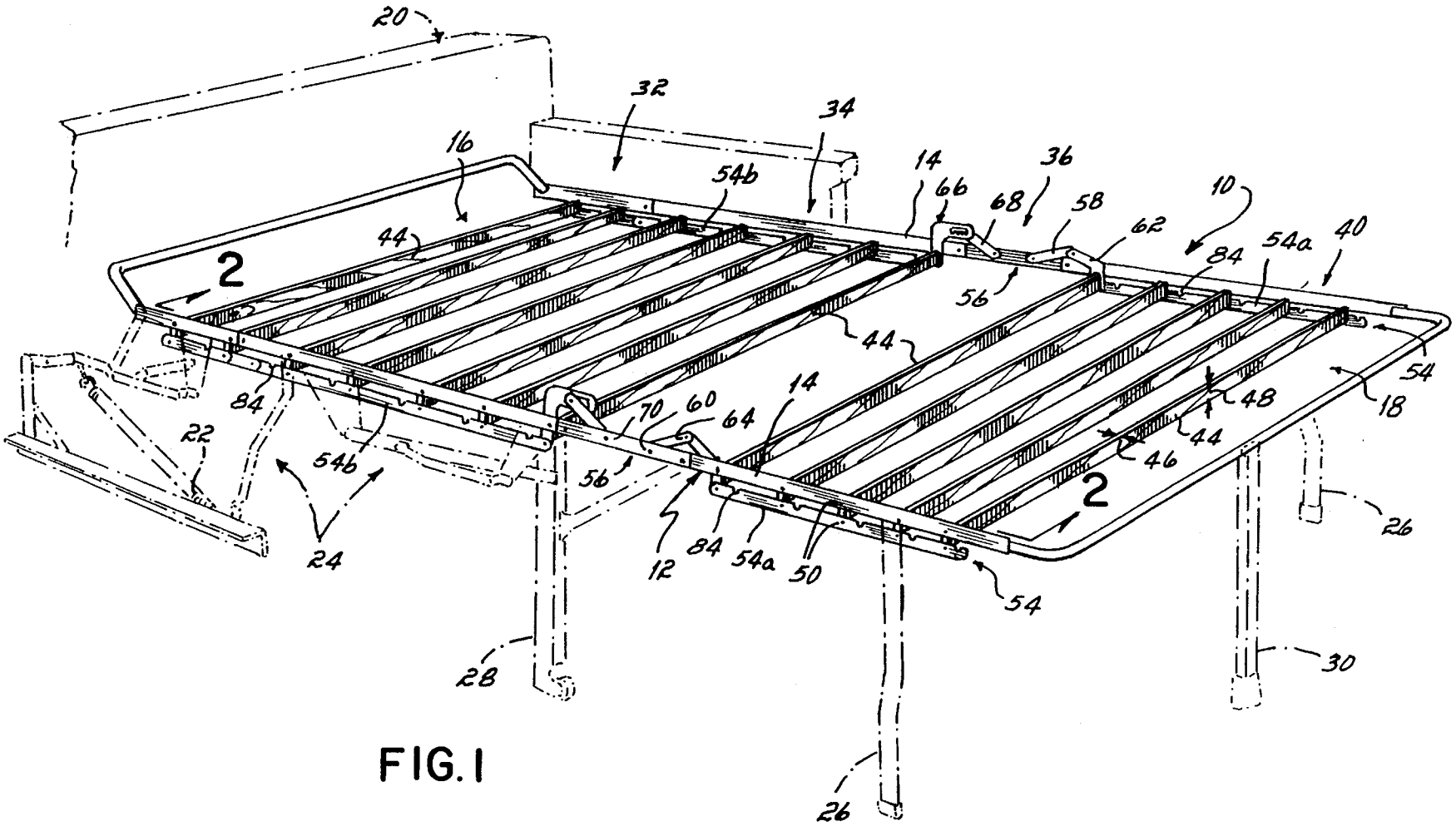
FIG. 1 is a perspective view of a sofa sleeper with a deck in the extended bed configuration according to a first embodiment of this invention.

Referring to FIG. 1, a sofa sleeper deck 10 according to a first embodiment of this invention is shown and includes a foldable bed frame 12 having opposed lateral sides 14, 14 extending between a head end 16 and a foot end 18 of the frame 12. The bed frame 12 is foldable to and between a collapsed sofa configuration (FIG. 4) and an extended generally flat bed configuration (FIG. 1). In the sofa configuration, the deck 10 is collapsed and folded into a sofa 20 as by a combination of a spring 22 and multi-bar linkage 24 connected to both the bed frame 12 and the sofa 20 as is known by one of ordinary skill in the art and shown in phantom lines in FIG. 1. To support the bed frame 12 and sofa sleeper deck 10 in the bed configuration, forward and aft frame supporting legs 26, 28 are provided on each lateral side 14 of the frame 12. In addition, a center leg 30 may be provided at the foot end 18 of the frame 12. The sofa sleeper deck 10 of this invention offers a generally flat and planar surface to support a mattress (not shown) and provide a comfortable sleeping surface.

The sofa sleeper deck 10 of this invention includes serially and pivotally interconnected head panel 32, body panel 34, intermediate panel 36, and foot panel 40 sections. The head panel section 32 underlies the head of the person lying prone on the sofa sleeper deck 10 and the foot panel section 40 supports the feet of the person. The body panel section 34 and intermediate panel section 36 support the torso and legs of the person, respectively. It will be appreciated by one of ordinary skill in the art that the scope of this invention is not limited to the particular bed frame, multi-bar linkage connecting the frame to the sofa, frame supporting legs, or the like as those features are shown and described herein.

As shown in FIG. 1, the sofa sleeper deck 10 according to this invention includes a plurality of transverse generally parallel slats 44 extending across the width on the sofa sleeper deck 10. In one embodiment of the invention, the slats 44 extend across the foot and body sections 40, 34 of the deck. As shown more clearly in FIGS. 1–5, each slat 44 has a major dimension 48 greater than a minor dimension 46 thereof and in one preferred embodiment has a generally oval cross-sectional configuration. The slats 44 are preferably constructed of wood, but may be constructed of plastic, wire trusses, metal, or other appropriate material. Furthermore, it will be appreciated that other configurations of the slats are also possible within the scope of this invention.

Figure 2:
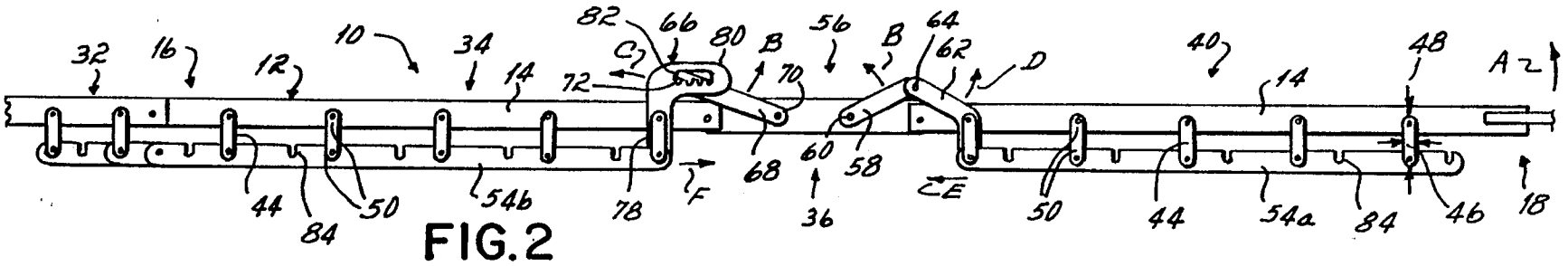
FIG. 2 is a cross-sectional view taken along line 2—2 of the sofa sleeper deck of FIG. 1.

As shown in FIGS. 1 and 2, the slats 44 are generally parallel and in a vertical orientation so that an upper end or edge of the slat underlies and supports the mattress on the deck 10. With the slats 44 generally vertical, a very rigid support surface is provided for the mattress with the larger major dimension 48 of each slat 44 being aligned with the direction of the applied generally vertical force resulting from a person lying, sitting or resting upon the mattress on the sofa sleeper deck 10.

Each slat 44 is pivotally coupled as by a pair of pins 50 to a side frame member 14 of the foldable frame 12 and linkage bars 54 as shown in FIGS. 1–5. In this embodiment of the invention, the linkage bar 54 is below or underlies the foldable frame 12 when the deck 10 is in the bed configuration. The slats 44 extending across the foot section 40 of the deck 10 are connected to a linkage bar 54*a* underlying the foot section 40 and the slats 44 extending across the body section 34 of the deck are connected to a linkage bar 54*b* underlying the body section 34.

As shown in FIGS. 2–5, a four bar linkage assembly 56 is provided at the head end of the foot panel section 40 and includes a straight link 58 pivotally coupled with a pin 60 at a first end to the intermediate section 36 of the frame 12 and a bent link 62 secured to the slat 44 at the head end of the foot panel section 40. A second end of the straight link 58 and a second end of the bent link 62 are pivotally coupled together by pin 64 and in combination with the pivotal joint between the intermediate and foot sections 36, 40 of the frame 12 combine to form the four bar assembly 56.

Similarly, a generally L-shaped lever 66 having first and second legs 78, 80 is provided at the tail end of the body section panel 34 and is secured to the slat 44 of the body section 34 closest to the foot end of the bed. Another straight link 68 is pivotally coupled by a pin 70 at a first end to the intermediate section 36 and has a pin 72 extending from a second end thereof. The pin 72 is designed to engage any one of a number of slots 74 formed in the second leg 80 of the L-shaped lever 66. In the second leg 80 of the L-shaped lever 66, a cutout 82 includes the plurality of slots 74 which are adapted to receive the pin 72 extending from the second end of the link 68.

Figure 3:
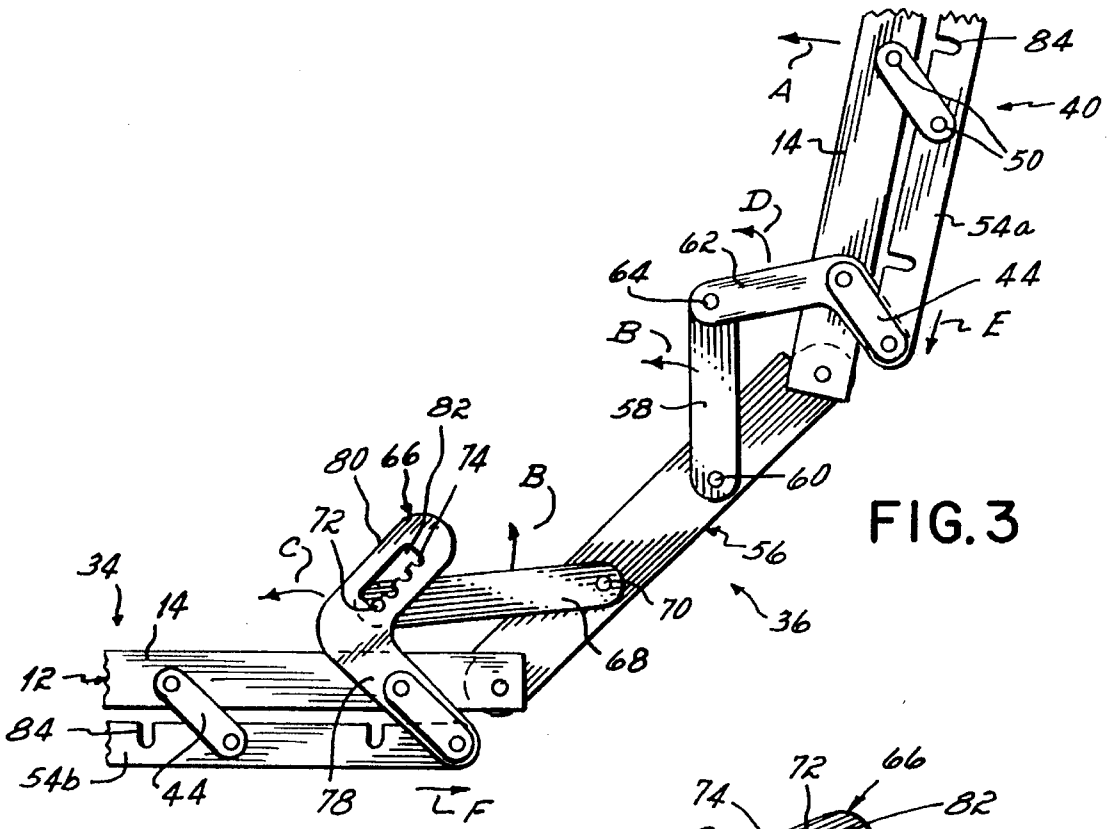
FIG. 3 is a partial cross-sectional view of the sofa sleeper deck of FIG. 1 being transformed between the bed and sofa configurations.

In transforming the deck 10 from the bed configuration to the collapsed sofa configuration, the foot end 18 of the deck 10 is raised upwardly in the direction of arrow A as shown in FIG. 2 thereby pivoting the links 58, 68 in the direction of arrow B and the lever 66 and bent link 62 in the direction of arrows C and D, respectively, as shown in FIGS. 2 and 3. As the links 58, 68, 62 and lever 66 pivot in the indicated directions, the linkage bars 54 translate relative to the frame 12 of the deck 10 in the direction of arrows E and F thereby pivoting the slats 44 from the generally vertical configuration toward the horizontal configuration.

Figure 4:
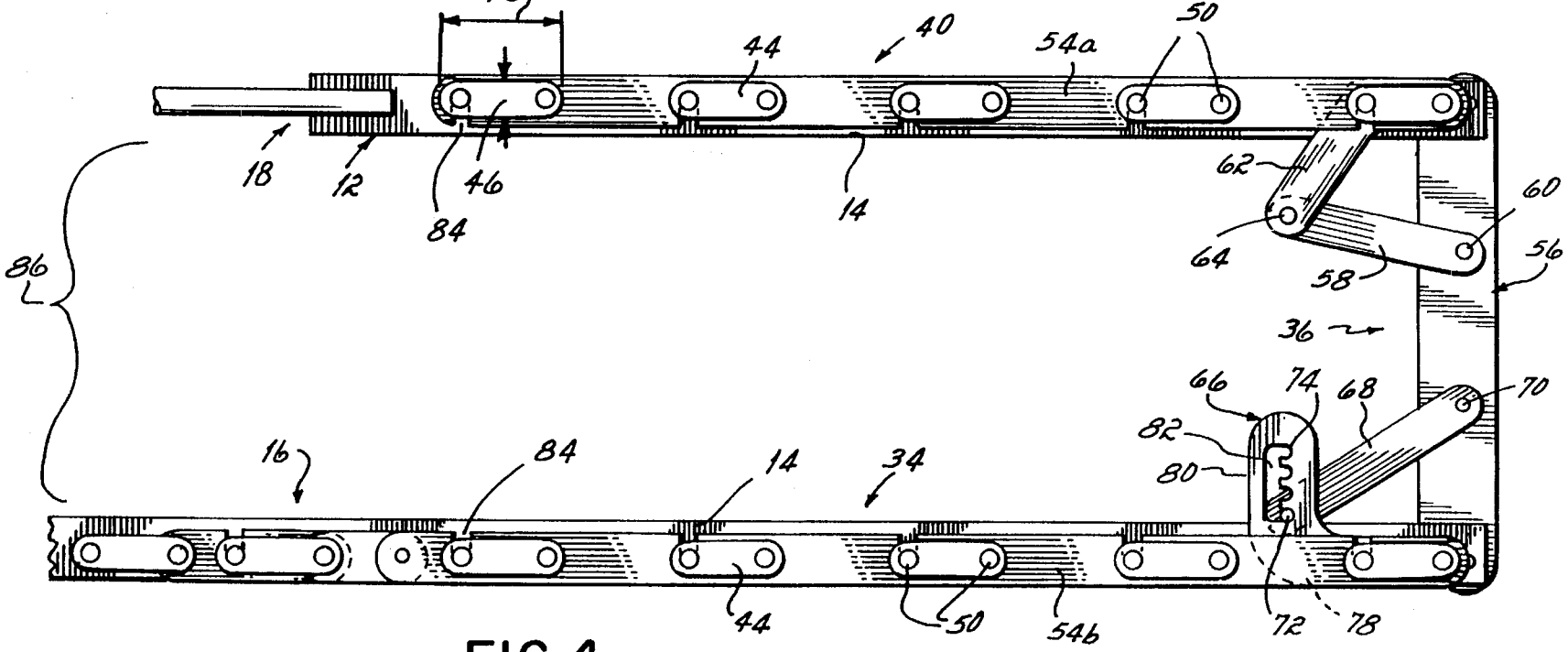
FIG. 4 is a cross-sectional view of the deck of FIGS. 1 and 2 in the folded sofa configuration.

With the deck 10 transformed to the collapsed U-shaped configuration shown in FIG. 4, the linkage bars 54 have shifted to be generally coplanar with the side members 14 of the frame 12 to which they are attached and the individual slats 44 have pivoted from the generally vertical configuration shown in FIG. 2 to a horizontal configuration as shown in FIG. 4, In order to secure the deck 10 and slats 44 in the collapsed and horizontal positions, respectively, a latch mechanism is provided to retain each pivot pin 50 coupling each slat 44 to the bed frame 12. As shown in FIG. 4, the pivot pin 50 connected to the bed frame is received within a slot 84 on the linkage bar 54 to thereby releasably secure the bed frame 12 in the collapsed configuration and inhibit further angular rotation of the slats 44.

It will be appreciated by one of ordinary skill in the art that in the collapsed configuration with the slats 44 in a generally horizontal position, the deck 10 is more yielding and offers to find a comfortable seating area for the sofa 20 in that the generally vertical load applied to the sofa 20 from one sitting or resting thereon is supported by the more narrow minor dimension 46 of each slat 44. As a result, a less resilient and more comfortable sofa 20 is provided with the deck 10 according to this invention.

Furthermore, with the slats 44 pivoted to the horizontal position as shown in FIG. 4, a larger cavity 86 is provided between the now parallel foot and body portions 40, 34 of the deck 10. As a result, a larger space for the mattress to be folded into is available with the slats 44 rotated to the flat, horizontal position. Therefore, a thicker mattress can be used with the sofa sleeper deck 10 of this invention without altering the sofa cavity into which the deck 10 and mattress are collapsed. It will be appreciated by one of ordinary skill in the art that as the sofa sleeper is transformed from the sofa collapsed configuration to the extended bed configuration that the slats 44 rotate toward a vertical more rigid position to provide a stable and resilient deck.

Figure 5:
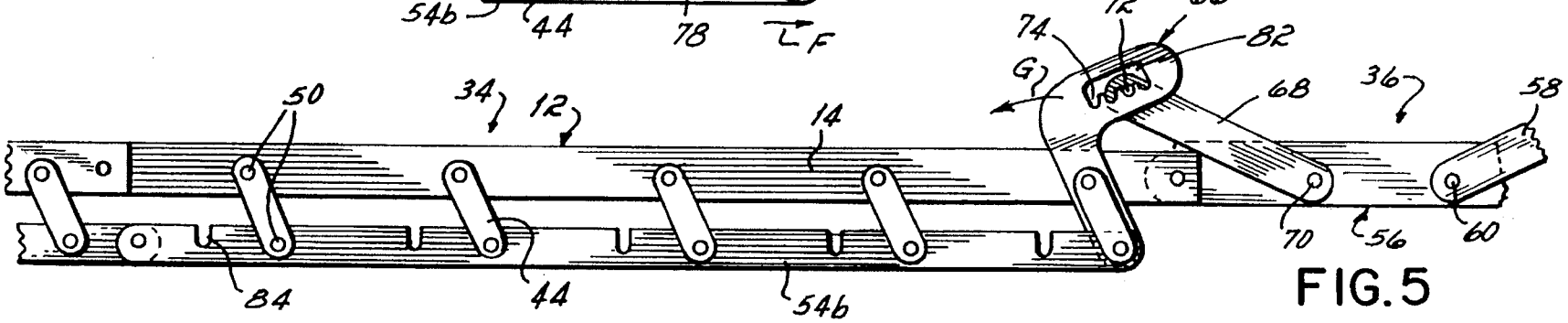
FIG. 5 is a view similar to FIG. 2 with the angular orientation of the slats adjusted with the lever.

In the first preferred embodiment of the invention, the angular orientation of the slats 44 can be manually adjusted by re-positioning the pin 72 in the second end of the link 68 into each of the various slots 74 provided in the cutout 82 in the second leg 80 of the lever 66. As seen by comparing FIGS. 2 and 5, with the pin 72 secured into the head end most slot of the cutout 82, the slats 44 are in the vertical configuration thereby providing the most rigid support surface for the mattress in the bed configuration. As the pin 72 is adjusted to one the more rearward slots, as for example the third slot as shown in FIG. 5, the lever 66 is pivoted in the direction of arrow G to thereby adjust the angular inclination of the slats 44 away from the vertical orientation and toward a canted orientation. As a result, the deck 10 is less rigid with the slats 44 in the canted orientation as shown in FIG. 5 thereby affording the user the ability to selectively adjust the rigidity of the sleeping surface according to personal preference. It can readily be appreciated that the lever 66 can be adapted for use with the other panels or sections of the deck 10.

Figure 6:
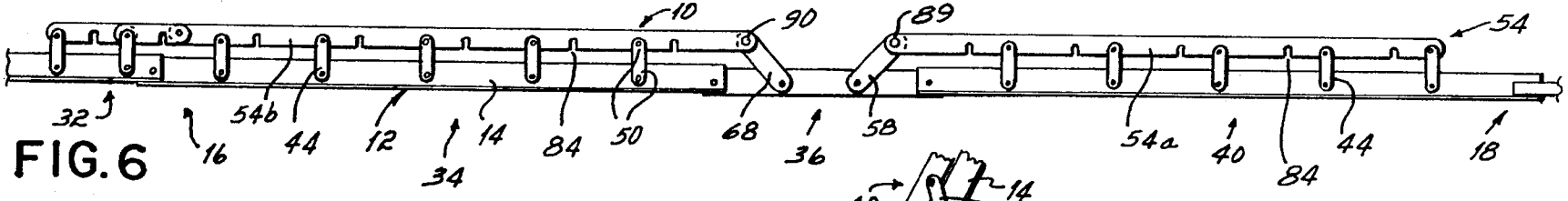
FIG. 6 is a cross-sectional view similar to FIG. 2 but of a second embodiment of this invention.
Figure 7:
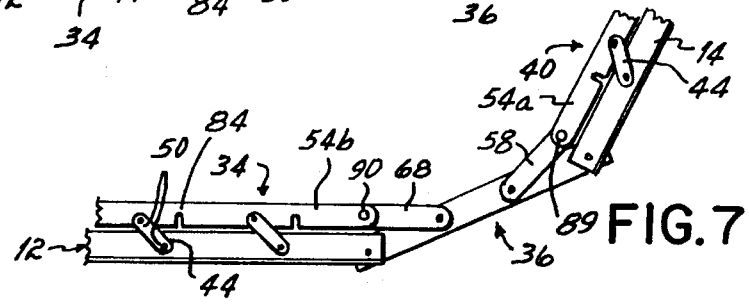
FIG. 7 is a partial cross-sectional view of the sofa sleeper deck of FIG. 6 being transformed between the bed and sofa configurations.
Figure 8:
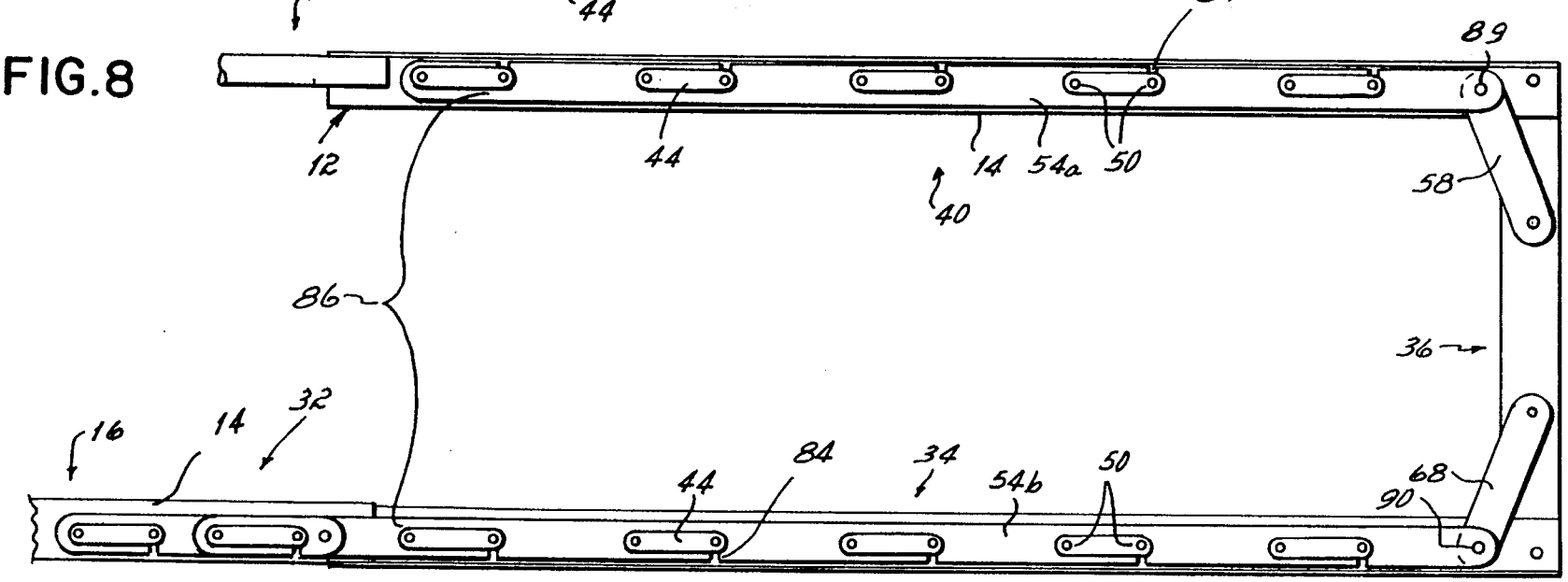
FIG. 8 is a cross-sectional view of the deck of FIGS. 6 and 7 in the folded sofa configuration.

A cross-sectional view of a second preferred embodiment of the deck of this invention is shown in FIG. 6. Elements and features of the second embodiment of the invention which are common to those of the first embodiment of the invention shown in FIGS. 1–5 are indicated with like reference numerals in FIGS. 6–8. The primary difference between the second embodiment and the first embodiment is the position of the linkage bars 54 relative to the frame 12 of the sofa sleeper deck 10. As shown in FIGS. 6–8, the linkage bars 54 are positioned parallel to and above the frame 12 of the deck 10 in the second embodiment. Each slat 44 is pivotally coupled to both the side frame member 14 of the deck 10 and the linkage bar 54 as in the first embodiment. However, in this embodiment the linkage bars 54 are positioned above the side frame members 14 with the deck 10 in the extended bed configuration.

Another difference between the first and second embodiments of the invention is that the straight links 58, 68 are pivotally coupled by pins 89, 90 directly to the linkage bars a, **54*b* connected to the body section 34, as opposed to the L-shaped levers of the first embodiment. Therefore, because of the absence of the L-shaped lever at the body section 34, the angular orientation of the slats 44 in the bed configuration of this embodiment is not adjustable; however, it will be appreciated that the lever 66 or another mechanism for adjusting the inclination of the slats 44** could be incorporated into the second embodiment of the invention.

As a result of the pivotal slats 44 provided by the sofa sleeper deck 10 according to the various embodiments of this invention, a rigid stable support surface is provided for the mattress on the deck 10 in the bed configuration with the slats 44 in a generally vertical configuration. In addition, the slats 44 are pivoted to a generally horizontal position when the deck 10 is collapsed into the sofa configuration to provide a comfortable cushioned seating surface for the sofa 20 and a larger cavity 86 between the respective portions of the deck 10 to accommodate a thicker and/or larger mattress therein.

From the above disclosure of the general principles of this invention and the preceding detailed description of preferred embodiments, those skilled in the art will readily comprehend the various modifications to which the present invention is susceptible. Therefore, I desire to be limited only by the scope of the following claims and equivalents thereof.

I claim:

1. A deck for a sofa-sleeper, said deck being capable of articulating to and between a collapsed sofa configuration and an extended, generally horizontal bed configuration, said deck comprising:

a perimeter frame having opposed side frame members;

a plurality of generally parallel slats extending lengthwise laterally between said side frame members, each said slat having a major width dimension greater than a minor thickness dimension thereof; and a linkage connecting said slates to said frame, said linkage enabling said slats to pivot to and between a vertical configuration in which each said slat major dimension is generally vertical and a horizontal configuration in which each said slat major dimension is generally horizontal.

2. The deck of claim 1 wherein said linkage further comprises:

at least one linkage bar connected to each said side frame member, said linkage bar maintaining a parallel relationship with respect to said side frame member connected thereto as the deck articulates to and between the collapsed and extended configurations, an end of each said slat being pivotally coupled to both said linkage bar and said side frame member; and a link pivotally coupled at a first end to said side frame member and at a second end to said bar, said link and said bar pivoting said slats to and between said horizontal and said vertical configurations.

3. The deck of claim 2 wherein each said linkage bar is above said frame when the deck is in the extended configuration and in a common plane with said side frame member connected thereto when the deck is in the collapsed configuration.

4. The deck of claim 2 wherein each said linkage bar is below said frame when the deck is in the extended configuration and in a common plane with said side frame member connected thereto when the deck is in the collapsed configuration.

5. The deck of claim 1 wherein said slat vertical configuration corresponds to the bed configuration of the deck and said slat horizontal configuration corresponds to the sofa configuration of the deck.

6. The deck of claim 1 further comprising:

a latch mechanism to secure each said slat in said horizontal configuration when the deck is in the collapsed configuration.

7. The deck of claim 6 wherein said latch mechanism comprises:

a plurality of notches on said linkage, each one of said notches being adapted to receive and retain a pivot pin coupling one of said slats to one of said side frame members when the deck is in the sofa configuration.

8. The deck of claim 1 further comprising:

serially connected head, body, intermediate and foot sections of the deck, said body and foot sections being generally horizontal in both the extended and collapsed configurations of the deck and said intermediate section being generally horizontal in the extended deck configuration and generally vertical in the collapsed deck configuration.

9. The deck of claim 1 further comprising:

an actuator connected to said frame and said linkage, said actuator selectively positioning said slats at a plurality of angular inclinations between said vertical and horizontal slat configurations.

10. The deck of claim 9 wherein said actuator comprises:

an L-shaped lever having a first leg generally perpendicular to a second leg thereof, said first leg being connected to one of said slats and said second leg having a plurality of aligned slots therein; and a link pivotally coupled at a first end to said side frame and coupled at a second end to said second leg of said lever, said link being selectively positionable in said slots in said lever second leg to adjust the angular inclination of said slats.

11. The deck of claim 1 wherein said linkage is operative to automatically move said slats from said vertical configuration to said horizontal configuration when said frame is moved from said horizontal bed configuration to said collapsed sofa configuration and from said horizontal configuration to said vertical configuration when said frame is moved from said collapsed sofa configuration to said horizontal bed configuration.

12. A deck for a sofa-sleeper, said deck being capable of articulating to and between a collapsed sofa configuration and an extended, generally horizontal bed configuration, said deck comprising:

a perimeter frame having serially connected head, body, intermediate and foot sections of the deck, said body and foot sections being generally horizontal in both the extended and collapsed configurations of the deck and said intermediate section being generally horizontal in the extended deck configuration and generally vertical in the collapsed deck configuration;

a plurality of generally parallel slats extending laterally between opposed sides of said body and foot sections, each said slat having a major dimension greater than a minor dimension thereof;

a linkage connecting said slates to said frame, said linkage enabling said slats to pivot to and between a vertical configuration in which each said slat major dimension is generally vertical and a horizontal configuration in which each said slat major dimension is generally horizontal;

said linkage further comprising:

a linkage bar connected to each said side of said body and foot sections and to a side of said frame, each said linkage bar maintaining a parallel relationship with respect to said side of said frame connected thereto as the deck articulates to and between the collapsed and extended configurations, an end of each said slat being pivotally coupled to both said frame side and one of said linkage bars; and a link pivotally coupled at a first end to each said side of said body and foot sections and at a second end to said side of said frame, said link and said bars pivoting said slats to and between said horizontal and said vertical configurations.

13. The deck of claim 12 wherein each said linkage bar is above said frame when the deck is in the extended configuration and in a common plane with said side frame member connected thereto when the deck is in the collapsed configuration.

14. The deck of claim 12 wherein each said linkage bar is below said frame when the deck is in the extended configuration and in a common plane with said side frame member connected thereto when the deck is in the collapsed configuration.

15. The deck of claim 12 further comprising:

a plurality of notches on said linkage bar, each one of said notches being adapted to receive and retain a pivot pin coupling one of said slats to one of said side frame members when the deck is in the sofa configuration.

16. The deck of claim 12 further comprising:

an actuator connected to said frame and said linkage, said actuator selectively positioning said slats at a plurality of angular inclinations between said vertical and horizontal slat configurations.

17. The deck of claim 12 wherein said actuator comprises:

an L-shaped lever having a first leg generally perpendicular to a second leg thereof, said first leg being connected to one of said slats and said second leg having a plurality of aligned slots therein; and a link pivotally coupled at a first end to said side frame and coupled at a second end to said second leg of said lever, said link being selectively positionable in said slots in said lever second leg to adjust the angular inclination of said slats.

18. A deck for a sofa-sleeper, said deck being capable of articulating to and between a collapsed sofa configuration and an extended, generally horizontal bed configuration, said deck comprising:

a perimeter frame having serially connected head, body, intermediate and foot sections of the deck, said head and foot sections being generally horizontal in both the extended and collapsed configurations of the deck and said intermediate section being generally horizontal in the extended deck configuration and generally vertical in the collapsed deck configuration;

a plurality of generally parallel slats extending laterally between opposed of body and foot sections, each said slat having a major dimension greater than a minor dimension thereof;

a linkage connecting said slates to said frame, said linkage enabling said slats to pivot to and between a vertical configuration in which each said slat major dimension is generally vertical and a horizontal configuration in which each said slat major dimension is generally horizontal;

an L-shaped lever having a first leg generally perpendicular to a second leg thereof, said first leg being connected to one of said slats and said second leg having a plurality of aligned slots therein; and a link pivotally coupled at a first end to said frame side and coupled at a second end to said second leg of said lever, said link being selectively positionable in said slots in said lever second leg to adjust the angular inclination of said slats.

19. A sofa-sleeper bed comprising:

a foldable bed frame;

a plurality of serially connected sections being attached to said bed frame, said sections being pivotal relative to one another to and between a folded sofa configuration and an extended generally flat bed configuration;

a plurality of transverse slats extending across selected ones of said sections, each said slat having a major dimension greater than a minor dimension thereof; and a linkage connecting said slats to said bed frame, said linkage enabling each said slat to pivot about a longitudinal axis of said slat.

20. The sofa-sleeper bed of claim 19 wherein said major dimension of each said slat is generally horizontal when said bed frame is in said sofa configuration.

21. The sofa-sleeper bed of claim 19 wherein said major dimension of each said slat is generally vertical when said bed frame is in said bed configuration.

* * * * *